US005447038A

United States Patent [19]

Vaynberg

[11] Patent Number: 5,447,038

[45] Date of Patent: Sep. 5, 1995

[54] APPARATUS FOR SIMULTANEOUSLY PROVIDING MULTIPLE TEMPERATURES USING AN AUTOMATICALLY CONFIGURABLE COOLING SYSTEM HAVING BOTH CASCADE AND SINGLE COMPRESSOR MODES

[75] Inventor: Mikhail M. Vaynberg, San Francisco, Calif.

[73] Assignee: Reefco Manufacturing Corporation, Mill Valley, Calif.

[21] Appl. No.: 153,172

[22] Filed: Nov. 16, 1993

[51] Int. Cl.[6] ..... F25B 7/00

[52] U.S. Cl. ..... 62/175; 62/335

[58] Field of Search ..... 62/175, 79, 335, 317

[56] References Cited

U.S. PATENT DOCUMENTS

| | | | |
|---|---|---|---|
| 2,968,933 | 1/1961 | Pfeifer et al. | 62/176 |
| 2,984,084 | 5/1961 | Talmey et al. | 62/239 |
| 3,316,731 | 5/1967 | Quick | 62/217 X |
| 3,386,260 | 6/1968 | Kirkpatrick | 62/239 |
| 3,572,052 | 3/1971 | Toth | 62/278 |
| 3,733,849 | 5/1973 | Cantagallo et al. | 62/414 |
| 4,313,309 | 2/1982 | Lehman, Jr. | 62/175 |
| 4,691,527 | 9/1987 | Ikeda | 62/234 |
| 5,187,945 | 2/1993 | Dixon | 62/234 |

OTHER PUBLICATIONS

YORK Transportation Equipment Service and Parts Manual Model TNE 256 NL, p. 9, FIG. 3.

YORK Transportation Refrigeration and Air Conditioning Equipment Twin-Pak TNE-255 Sales Brochure.

Billy C. Langley, "Heating, Ventilating, Air Conditioning and Refrigeration", pp. 56–58, Prentice-Hall, Inc. 1990.

Robert Chatenever, "Air Conditioning and Refrigeration for the Professional", pp. 171–174, John Wiley & Sons, Inc. 1988.

Roy J. Dossat, "Principles of Refrigeration", Third Edition, pp. 476–483, Prentice-Hall, Inc. 1991.

Andrew D. Althouse, Carl H. Turnquist, Alfred F. Bracciano, "Modern Refrigeration and Air Conditioning", The Goodheart-Wilcox Company, Inc. 1992, pp. 75–99.

Coldwrap Sea Containers Inc., "The Story Of Our New Rent-A-Container Is A Lot Of Cold Air," Sales Brochure.

"1990 ASHRAE Handbook Refrigeration Systems and Applications", American Society of Heating, Refrigerating and Air Conditioning Engineers, Inc., pp. 28.1–30.16.

"ASHRAE Handbook 1982 Applications", American Society of Heating, Refrigerating and Air Conditioning Engineers, Inc., pp. 43.1–45.18.

"1986 ASHRAE Handbook Refrigeration System and Applications", American Society of Heating, Refrigerating and Air Conditioning Engineers, Inc., pp. 28.1–30.18.

THERMO KING Sales Brochure for Models SB-III & SB-III MAX.

*Primary Examiner*—William E. Wayner

*Attorney, Agent, or Firm*—Haverstock, Medlen & Carroll

[57] ABSTRACT

A broad range cooling system is provided which can operate over a temperature range of −25° F. to 75° F. under any expected ambient temperatures. The system includes two compressor systems which are configurable to operate independently and as a cascade system to provide multiple cooling temperatures for multiple loads each having a particular temperature requirement. There are multiple evaporator systems for cooling air which is used to cool the product; one evaporator system for each desired temperature. Each evaporator system is provided a thermal expansion valve, a corresponding thermostatic bulb and a thermostat to control the temperature in a corresponding chamber. The container is partitioned into chambers, each chamber having an evaporator system so that each evaporator system provides positive temperature control within its chamber. An evaporator pressure regulator is provided to manitain the evaporator pressure higher and thereby allow the several evaporators to maintain different pressures. The cascade cooling mode utilizing both compressors provides additional cooling capability for allowing even more temperature selectivity below 0° F.

10 Claims, 4 Drawing Sheets

APPARATUS FOR SIMULTANEOUSLY PROVIDING MULTIPLE TEMPERATURES USING AN AUTOMATICALLY CONFIGURABLE COOLING SYSTEM HAVING BOTH CASCADE AND SINGLE COMPRESSOR MODES

FIELD OF THE INVENTION

This invention relates to the field of cooling systems. More particularly, this invention relates to the field of cascade refrigeration systems.

BACKGROUND OF THE INVENTION

Single compressor systems are well known for cooling. Such systems are commonly used in refrigerated containers for trucks, rail and shipboard transportation of food products. Note however, that the present invention is not restricted to transportation applications of refrigerated container.

Single compressor containers are unequal to certain cooling tasks. For example, once produce is picked it is desirable to immediately reduce its temperature to prevent spoiling. During hot summer months, shippers of produce transport the produce to a cold storage warehouse to bring the produce down to temperature before loading onto a refrigerated container which merely operates to maintain the temperature of the precooled produce are incapable of bringing the produce to temperature quickly enough. The ability of such transportation devices to cool a hot load of produce in a sufficiently short time to prevent spoilage does not exist in commercially-available containers.

Most commercially-available refrigerated containers for transportation are single compressor systems. Generally, single compressor systems are inadequate for cooling a load below about −20° F. Some commercially-available refrigerated containers having single compressor systems can cool a load to about 0° F. Unfortunately, purchasers of refrigerated containers desire a device which can maintain a load at −20° F. and lower at ambient temperatures up to +150° F.

By way of example, consider a single compressor system for cooling a load to −20° F. in an ambient environment of 150° F. The evaporator temperature necessary to maintain the load at a predetermined temperature is at the best 10° F. colder than the load. Here the evaporator is cooled to −30° F. Under these conditions using R12, the evaporator pressure is expected to be approximately 9 psi and using R22, the expected pressure is approximately 20 psi. Similarly, the condenser temperature necessary to discharge heat to the ambient is 10° to 40° warmer than the ambient under the best case conditions; thus, in this example, the condenser is at 160° F. The pressure in the condenser under these conditions is expected to be approximately 278 psi for R12 and 445 psi for R22.

The conditions in the example of the previous paragraph dictate a compression ratio of $278/9 \approx 31$ for R12 and $445/20 = 22$ for R22. Refrigeration compressors are designed to operate with a compression ratio no greater than 15. If the pressure ratio exceeds the manufacturer's design criteria the compressor will break. Accordingly, neither example above could be achieved with a conventional single compressor system. Indeed, a commercially available compressor is not available with the capacity to operate in a refrigerated container environment under the above conditions and accordingly, such a system in a refrigerated container would be prohibitively expensive and inefficient. Thus, commercially available single compressor systems are incapable of operating where the difference between the desired product temperature and the actual ambient temperature is very large as in these examples.

Cascade systems are well known. It is well understood in cascade systems that heat from a lower cascade condenser is removed by the evaporator of a high cascade compressor system; and heat from the high cascade system is dissipated into the ambient. The pressure ratio for the cascade system is the product of the pressure ratio for both the low cascade compressor system and the high cascade compressor system. A cascade system for the R22 example described above would also have a pressure ratio of approximately 22 and it could have both the low and high compressor systems operating at the same pressure ratios, i.e., both pressure ratios at approximately 4.7 for each compressor. This pressure ratio is well within an acceptable range of the specifications of commercially available compressors.

Conventional cascade systems use different refrigerants, one for each compressor in each system. This requires the system designer to uniquely design the low compressor system and the high compressor system. Commonly used refrigerants are 502 and R12. To protect the environment, these refrigerants will be banned after 1995. The refrigerant R22 is far less damaging to the environment than 502 or R12 and as such is not scheduled to be banned until 2020.

Most refrigerated containers for transporting cooled products are designed for generation of a single temperature within the entire container. This is acceptable for large container sized loads. However, there are situations where it is desirable to transport smaller loads, each load requiring a different temperature, e.g., frozen ice cream, meat and lettuce. Unfortunately, such systems require shippers and cold storage operators to continually make compromises when storing multiple loads of articles each having a different temperature requirement. The operator must select a cooling temperature that will have the least negative impact on all the various loads within the refrigerated environment.

Others have tried to solve this problem by erecting barriers between chambers of a container. A vent or opening is formed between the various temperature chambers. The chamber requiring the coldest temperature is directly cooled by a compressor system in the usual manner. The next warmer chamber is cooled either by the cold air spilling from the coldest chamber through the vent or being blown through the vent by a fan until an equilibrium is reached between the set temperature and the chamber temperature. Further, if the cold air comes from the chamber with fish to a chamber with apples the aroma of fish will not benefit the taste of apples and vice versa.

What is needed is a cooling system for cooling a load of product to a desired temperature which can efficiently operate over a broad range of ambient temperatures, e.g., −60° F. to +150° F. and load temperatures from −25° F. to +75° F. and further which can generate multiple cooling temperatures to suit load of varying specifications.

SUMMARY OF THE INVENTION

A broad range cooling system is provided which can operate over a temperature range of −30° F. to 75° F. under any expected ambient temperatures. The system includes two compressor systems which are configurable to operate for the high cascade system independently and as a cascade system to provide additional low temperature cooling for multiple loads each having a particular temperature requirement. There are multiple evaporator systems for cooling air which is used to cool the product; one evaporator system for each desired temperature. Each evaporator system is provided with a thermal expansion valve, a corresponding thermostatic bulb and a corresponding thermostat which is settable to adjust the evaporating temperature of each evaporator system. The container is partitioned into chambers, each chamber having an evaporator system, so that each evaporator system provides positive temperature control within its chamber. An evaporator pressure regulator is provided to keep the evaporator pressure/temperature higher and to provide control for higher temperatures in corresponding chambers. The cascade cooling mode utilizing both compressors provides additional cooling capability for low temperatures allowing even more temperature selectivity.

DETAILED DESCRIPTION OF THE PREFERRED EMBODIMENT

Figure 1A:
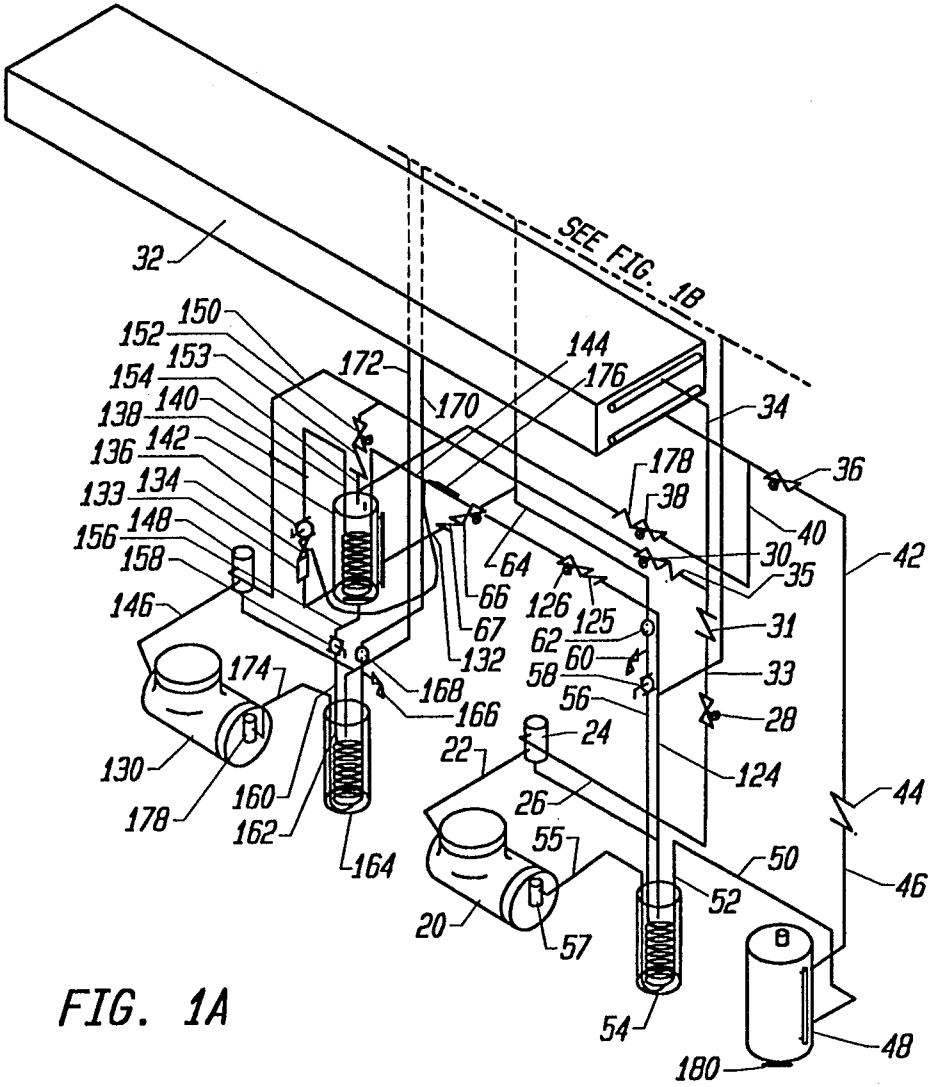
FIG. 1 shows a perspective view of a schematic diagram of a cooling system designed to achieve a broad range of cooling temperatures over a broad range of ambient temperatures.
Figure 1B:
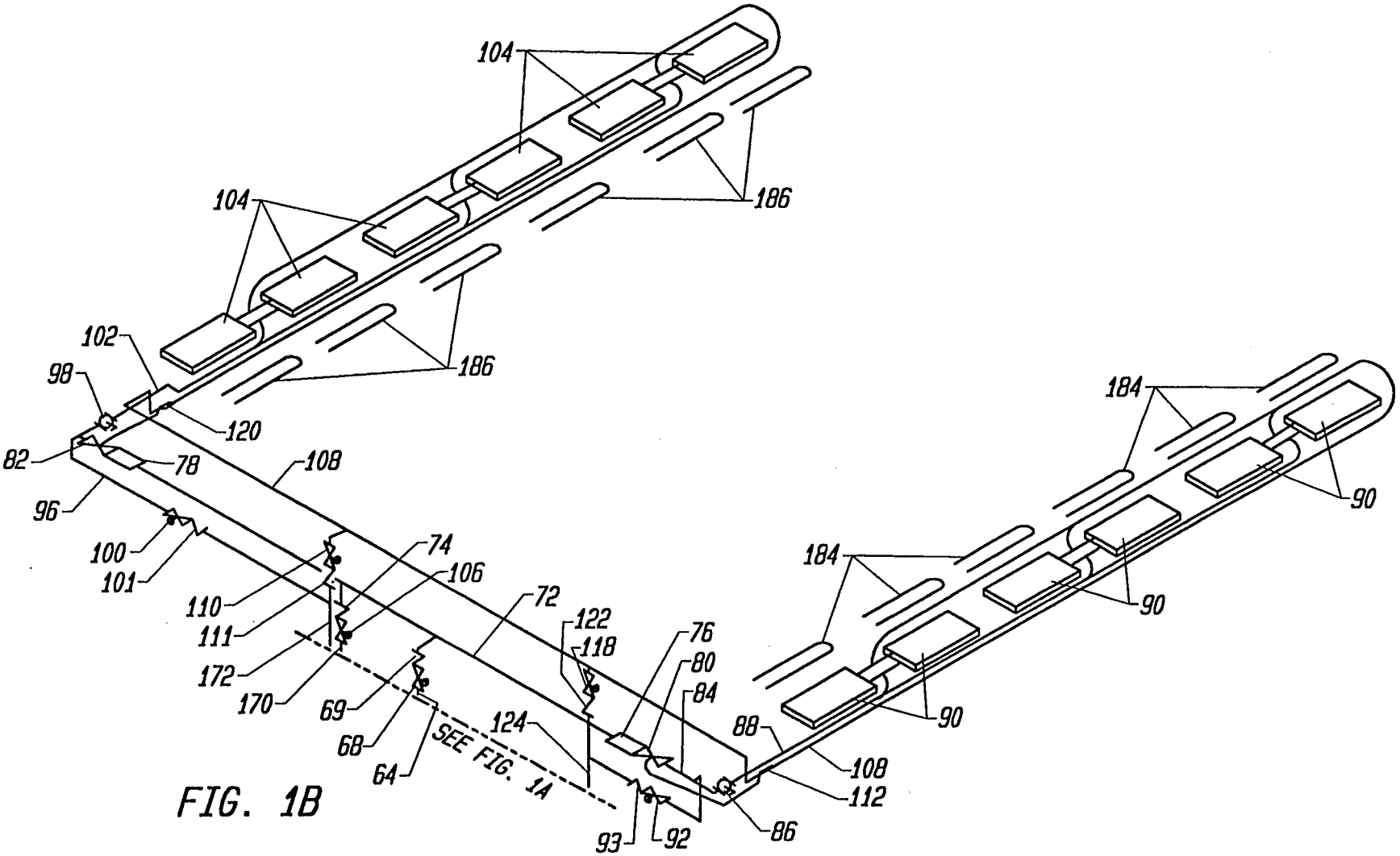

In his co-pending patent application Ser. No. 08/153,173, filed on Nov. 16, 1993 (the same day as this application) the inventor teaches one embodiment, as shown in FIG. 1, of a broad temperature range cooling system is provided which can operate over a load temperature range of −25° F. to 75° F. and an ambient temperature range from −60° F. to +150° F. That application is incorporated herein by reference. That system is configured to operate as two independent single compressor systems, each one operating at a time, or as cascade cooling system. If the difference between the desired temperature of the product and the ambient temperature is sufficiently small, the apparatus according to that system can automatically configure itself to operate the smaller or the bigger one of the two compressor systems. The two compressor systems preferably have different compressor capacity to provide an even broader range of cooling control. Either compressor can be used in the single compressor mode. The difference is deemed sufficiently small if the pressure ratio would be too small to operate effectively if that system were configured in cascade mode.

If the difference between the set temperature of the product and the ambient temperature is sufficiently large, the apparatus can automatically configure the system to operate in the cascade mode. The difference is deemed large if the pressure ratio when operating in single compressor mode would exceed the acceptable specifications. Because either compressor can be configured to provide liquid to the evaporators, and because each compressor has its own supply of refrigerant, that system includes means for draining the refrigerant from the evaporators prior to releasing control of the evaporator.

In the event that the system is operating as a single cooling system using only the compressor 20, the compressor 20 compresses the gas into the hot gas line 22 which is applied to the oil separator 24. Up to 98% of the oil that is present in the compressed gas is separated from the gas in the oil separator 24, and the gas is applied to the hot gas line 26. The hot gas line 26 is coupled to a hot gas solenoid 28 which is open. The hot gas solenoid 28 is coupled to check valve 31 via a hot gas pipe 33. The check valve 31 is coupled to a check valve 35 and to a condenser 32 via a hot gas "Y" pipe 34. The check valve 35 is coupled to a hot gas solenoid 30 which is closed. For the purposes of this specification, a "Y" pipe is defined as a pipe that is plumbed to couple more than two elements on the cooling circuit to one another.

The hot gas gives up heat to the air and condenses to a liquid in the condenser 32. The output of the condenser is coupled to two liquid solenoids, 36 and 38, via the liquid "Y" pipe 40. The liquid solenoid 38 is closed, and the liquid passes through liquid solenoid 36 into the liquid pipe 42 to a check valve 44. A liquid pipe 46 is coupled between the output of the check valve 44 and the input of a linear receiver 48.

The output of the linear receiver 48 is coupled to the input of a coil 52 of a suction accumulator 54 via a liquid pipe 50. The output of the coil 52 of the suction accumulator 54 is coupled to a liquid pipe 56, which is coupled in turn to a ball valve 58. The output of the ball valve is coupled to a charge valve 60 which in turn is coupled to a sighting glass 62. The output of the sighting glass 62 is coupled to a liquid "Y" pipe 64, which in turn is coupled to two liquid solenoids 66 and 68.

In the single compressor mode, the liquid solenoid 66 is closed, and the solenoid 68 is open. The output of the liquid solenoid 68 is coupled to a check valve 69 which in turn is coupled to a liquid "Y" pipe 72, which in turn is coupled to a check valve 74, and two filter/dryers 76 and 78. The check valve 74 is coupled to a solenoid 106. The filter/dryer 76 is coupled to a thermostatically controlled thermal expansion valve 80 and the filter/dryer 78 is coupled to a thermostatically controlled thermal expansion valve 82.

The output of the thermal expansion valve 80 is coupled to a liquid "Y" pipe 84, which in turn is coupled to a ball valve 86 and a solenoid 92 which is closed. The output of the ball valve 86 is coupled to a "Y" pipe 88, which in turn is coupled to a plurality of evaporators 90. Similarly, the output of the thermal expansion valve 82 is coupled to a "Y" pipe 96, which in turn is coupled to a ball valve 98 and to a liquid solenoid 100. The output of the ball valve 98 is coupled to a liquid pipe 102, which in turn is coupled to a plurality of evaporators 104. In the single compressor operating mode, the liquid solenoids 74, 92, 100 and 106 are closed.

The liquid in the evaporators 90 absorbs heat wherein it evaporates to a cold gas which returns via the cold gas "Y" pipe 108. The cold gas "Y" pipe 108 is coupled to the cold gas solenoid 110 which is closed, to the cold gas solenoid 118 which is open and to the evaporators 104. A thermostatic bulb 112 of the thermal expansion valve 76 is mounted on the cold gas pipe 108. Similarly, the liquid applied to the evaporators 104 by the liquid pipe 102 evaporates to a cold gas which is coupled to the cold gas solenoid 118 and 110. A thermostatic bulb 120 of the thermal expansion valve 82 is also mounted on the cold gas pipe 108.

For the single compressor operation described above, the cold gas solenoid 110 is closed. The cold gas solenoid 118 is coupled to a check valve 122 which in turn is coupled to a "Y" pipe 124. The "Y" pipe 124 is coupled to the check valves 93 and 125 and to the shell of the suction accumulator 54. The check valve 125 is coupled to the cold gas solenoid 126 which is closed so the gas returns through the shell of the suction accumulator 54 to the cold gas pipe 55, to the suction filter 57 and finally to the compressor 20 where the cycle is complete.

The cooling system, according to FIG. 1, is set up for a refrigerated container having multiple evaporators. Accordingly, two sets of evaporator coils 90 and 104 are simultaneously utilized in that embodiment. It will be apparent to one of ordinary skill in the art that the evaporator coils 104, as well as the liquid solenoid 100, the filter dryer 78, the thermal expansion valve 82, the ball valve 98, the thermostatic bulb 120 and the associated piping can all be eliminated to provide a single evaporator system which can be used as in conventional refrigerated cooling systems.

In order to perform the cascade cooling operation, two compressor systems are provided. Each compressor has its own refrigerant. Preferably both refrigerants are of the same type. Thus, during a switch from a one compressor to a two compressor operation, the refrigerant and the oil from the first compressor system first needs to be removed from the evaporators 90 and 104 so that the refrigerant from a second compressor 130 can be used in the evaporators. This avoids the situation where one of the systems has too much refrigerant and oil and the other too little. The cascade cooling system according to the present invention is designed to use R22 refrigerant in each of the two compressors 20 and 130.

To remove the refrigerant from the evaporators after the system has operated in a single compressor mode using only compressor 20, the liquid solenoid 68 and cold gas solenoid 118 are closed. The remainder of the solenoids stay in their previous condition as described above. While the compressor 20 still operates, the liquid drain solenoid 92 is opened and the heaters 184 and 186 are energized. The heat from the heaters 184 and 186 boils the refrigerant and oil from the evaporators. The compressor continues to run until a low pressure switch cuts out the compressor which removes essentially all the refrigerant and oil from the system.

Once the evaporators 90 and 104 are cleared of refrigerant and oil, the cooling circuit for the compressor 20 is then conditioned to operate as follows. Hot gas is discharged from the compressor 20 through the hot gas line 22 into the oil separator 24. The hot gas leaves the oil separator 24 via the hot gas line 26 and then through the hot gas solenoid 28. The hot gas is coupled through the hot gas solenoid 28 to the hot gas pipe 33 to the check valve 31. Then, the hot gas is coupled to the hot gas "Y" pipe 34, which in turn is coupled to the hot gas solenoid 30 which is closed through the check valve 35, and to the condenser 32. The gas gives up heat to the air and is converted to a liquid in the condenser 32.

The output of the condenser 32 is coupled to the liquid "Y" pipe 40, which in turn is coupled to the liquid solenoids 36 and 38. The liquid solenoid 38 is closed, and the liquid from the condenser 32 passes through the liquid solenoid 36 into the liquid pipe 42. The liquid then passes through the check valve 44 into the liquid pipe 46, which is coupled to provide the liquid to the linear receiver 48. The liquid passes from the linear receiver 48 into the liquid pipe 50 and into the coil 52 of the suction accumulator 54. The liquid leaves the coil 52 of the suction accumulator 54 through the liquid pipe 56 and passes through the ball valve 58 and the sighting glass 62. A charge valve 60 is coupled to the pipe between the ball valve 58 and the sighting glass 62. The liquid is coupled to the liquid "Y" pipe 64. The solenoid 68 remains closed and the solenoid 66 is opened so that the liquid passes through the solenoid 66, the check valve 67 and into the liquid pipe 132. The liquid is coupled to a filter/dryer 133 which is coupled to a thermostatically controlled thermal expansion valve 134. The liquid passes through the thermal expansion valve 134, through a ball valve 136 and into the liquid pipe 138.

The liquid pipe 138 is coupled to provide the liquid to the coil 140 of a heat exchanger 142. The heat exchanger 142 contains an evaporator for the liquid which evaporates thereby forming a cold gas within the coil 140. The cold gas is coupled to a cold gas pipe 144, which passes through the now opened cold gas solenoid 126, the check valve 125 and into the cold gas pipe 124. The cold gas solenoid 118 and liquid drain solenoid 92 are closed so the cold gas passes through the shell of the suction accumulator 54, into the cold gas pipe 55, to the suction filter 57 and from there into the compressor 20.

At the same time the compressor 130 compresses a gas forming a hot gas which is discharged through a hot gas pipe 146 into an oil separator 148. The separated hot gas is discharged from the oil separator 148 into the hot gas "Y" pipe 150. The hot gas "Y" pipe 150 is coupled to the hot gas solenoid 30 and a hot gas solenoid 152. The hot gas solenoid 30 is closed, and the hot gas solenoid 152 is opened, which couples the hot gas through a check valve 153, the hot gas pipe 154, and into the shell of the heat exchanger 142.

Because the heat exchanger 142 contains an evaporator for the circuit of compressor 20 and a condenser for the circuit of compressor 130, the hot gas is cooled and condensed by the higher cascade compressor 20 circuit to a liquid within the heat exchanger 142. The liquid exits the heat exchanger 142 via a liquid pipe 156, and passes through the ball valve 158. The liquid leaves the ball valve 158 through the liquid pipe 160 into the coil 162 of a suction accumulator 164. The output of the coil 162 of the suction accumulator 164 passes through a sighting glass 168 and into the liquid "Y" pipe 170. A charge valve 166 is coupled to the pipe between the suction accumulator 164 and the sighting glass 168.

The liquid "Y" pipe 170 is coupled to the liquid solenoid 106. The output of the liquid solenoid 106 is coupled to the check valve 74 and then to the liquid "Y" pipe 72. The liquid solenoid 68 is closed so the liquid passes through the filter/dryers 76 and 78, the thermal expansion valves 80 and 82, into the liquid pipe 84 and 96, respectively. The liquid solenoid 92 is closed so the liquid in the pipe 84 passes through the ball valve 86 to the liquid "Y" pipe 88, the evaporators 90 and returns as a cold gas through the cold gas "Y" pipe 108. Similarly, the liquid solenoid 100 is closed so the liquid in the pipe 96 passes through the ball valve 98 to the liquid "Y" pipe 102, the evaporators 104 and returns as a cold gas through the cold gas "Y" pipe 108.

The cold gas solenoid 118 is closed so the cold gas passes through the open cold gas solenoid 110 and the check valve 111 into the cold gas "Y" pipe 172. The cold gas passes from the "Y" pipe 172 into the shell of the suction accumulator 164 and out through the cold gas pipe 174, into the suction filter 178 and back into the compressor 130. A thermostatic bulb 176 of the thermal expansion valve 134 is mounted on the pipe 144.

Operating in this cascade mode, the cooling system of the figure is capable of producing temperatures as cold as −25° F. even when the ambient temperature is as high as 150° F. This is because the hot gas in the cooling system of the compressor 130 is cooled in the heat exchanger 142 which contains an evaporator for the cooling system of the compressor 20. Thus, neither compressor need operate at pressure ratios beyond the manufacturer's specifications in order to achieve the necessary cooling.

The system can also operate under a single compressor mode using only the compressor 130. Here, because the refrigerant in the evaporators 90 and 108 is already the refrigerant for the compressor 130, there is no need to clear the refrigerant and oil from the evaporators.

In a single compressor mode of operation using the compressor 130, the hot gas is pumped by the compressor 130 through the hot gas pipe 146 into the oil separator 148. The hot gas leaves the oil separator via the hot gas "Y" pipe 150. The hot gas solenoid 152 is closed, and the hot gas solenoid 30 is open, so the hot gas passes through the hot gas solenoid 30, the check valve 35 and into the hot gas "Y" pipe 34. The hot gas solenoid 28 is closed, so the hot gas passes through the condenser 32 where it gives up heat to become a liquid and then leaves the condenser 32 via the liquid "Y" pipe 40.

The liquid solenoid 36 is closed, and the liquid solenoid 38 is open. The liquid passes through the liquid solenoid 38 through the check valve 178 into the hot gas pipe "Y" 154 and into the shell of the heat exchanger 142 which serves as a linear receiver in this mode. The liquid passes out of the heat exchanger 142 (receiver) into the liquid pipe 156 through the ball valve 158 and through the liquid pipe 160 into the coil 162 of the suction accumulator 164. The liquid leaves the coil 162 of the suction accumulator 164, passing by the charge valve 166 through the sighting glass 168, and into the liquid "Y" pipe 170.

The liquid passes through the liquid solenoid 106, the check valve 74 and into the liquid "Y" pipe 72. The liquid solenoid 68 is closed so the liquid passes through the filter/dryers 76 and 78, the thermal expansion valves 80 and 82, into the to the liquid pipe 84 and 96, respectively. The liquid solenoid 92 is closed so the liquid in the pipe 84 passes through the ball valve 86 to the liquid "Y" pipe 88, the evaporators 90 and returns as a cold gas through the cold gas "Y" pipe 108. Similarly, the liquid solenoid 100 is closed so the liquid in the pipe 96 passes through the ball valve 98 to the liquid "Y" pipe 102, the evaporators 104 and returns as a cold gas through the cold gas "Y" pipe 108.

The cold gas solenoid 118 is closed so the cold gas passes through the open cold gas solenoid 110 and the check valve 111 into the cold gas "Y" pipe 172. The cold gas passes from the "Y" pipe 172 into the shell of the suction accumulator 164 and out through the cold gas pipe 174, into the suction filter 178 and back into the compressor 130. A thermostatic bulb 176 of the thermal expansion valve 134 is mounted on the pipe 144.

For circumstances where the system changes from a cascade operation as described above or from a single compressor operation using the compressor 130 to a single compressor operation using the compressor 20, the refrigerant and oil must be cleared from the evaporators before the compressor 20 can supply the evaporators with refrigerant. The liquid solenoid 106 and cold gas solenoid 110 are closed. The remainder of the solenoids stay in their previous condition as described above. While the compressor 130 still operates, the liquid drain solenoid 100 is opened and the heaters 184 and 196 are energized. The heat from the heaters 184 and 186 boils the refrigerant and oil from the evaporators. The compressor continues to run until a low pressure switch cuts out the compressor which removes essentially all the refrigerant and oil from the system.

In certain cold climate conditions, the ambient temperature surrounding the cooling container is low enough that an insufficient pressure differential exists for the thermal expansion valves to open and feed the liquid refrigerant into the evaporators so that the cooling system will not operate. For such conditions of operation, the heaters 180 and 182 are provided in the base of the receiver and heat exchanger. The appropriate one of the heaters 180 or 182 will operate depending upon which compressor is configured to operate. The heaters are used to heat the liquid to a level for providing sufficient pressure differential to allow the system to start normally. Then the heater is turned off automatically when the corresponding compressor cuts in. In this way, such a container can be used from the hottest to the coldest climates.

Additional heaters 184 and 186 are provided to assist in defrosting of the evaporators 90 and 104, respectively. Under certain cold ambient temperatures, these heaters 184 and 186 can be used to maintain the product temperature higher than the ambient.

Preferably, the solenoids are automatically controlled by an electronic control system. In the preferred embodiment, the controller is a microprocessor. Temperature sensors regulate whether one or the other compressor operates, or both compressors operate as a cascade system depending upon the desired temperature of the load in relation to the ambient temperature.

In operation, the user enters the desired temperature into the controller (thermostat). Via its sensors, the controller senses the ambient temperature and the desired temperature. The controller calculates a difference value between the desired temperature and the ambient temperature and if beyond a preset threshold, automatically configures the system to operate in cascade mode. Otherwise, it configures the system to operate in single compressor mode using the compressor 20 or 130. If the system determines that one of the compressors is non-functional, it can automatically switch to operation as a single compressor system using the other compressor. Temperature sensor T1 is coupled to the controller to sense the temperature of the first chamber. The control system controls the temperature of the first chamber system by selectively conditioning the thermal expansion valve and its corresponding thermostat to maintain the desired temperature of the first chamber system.

The system described above achieves the goal of providing a broad range of cooling capability over a wide range of ambient temperatures. However, only a single cooling temperature inside the container can be provided because the evaporators are all concurrently controlled.

In his co-pending patent application Ser. No. 08/153,673, filed on Nov. 16, 1993 (the same day as this application) the inventor teaches a second embodiment of a broad temperature range cooling system. That application is incorporated herein by reference.

The present invention is directed to a single compressor and cascade mode refrigeration system that includes a plurality of evaporator systems, each separately controllable. Because of the inclusion of the additional control each evaporator systems can be used to provide a predetermined cooling temperature. Each evaporator system can be mounted within its own insulated volume of space for maintaining a product load a temperature unique to it. Using the teaching of this document, a designer will be able to select the system that best suits the needs of the application.

Figure 2A:
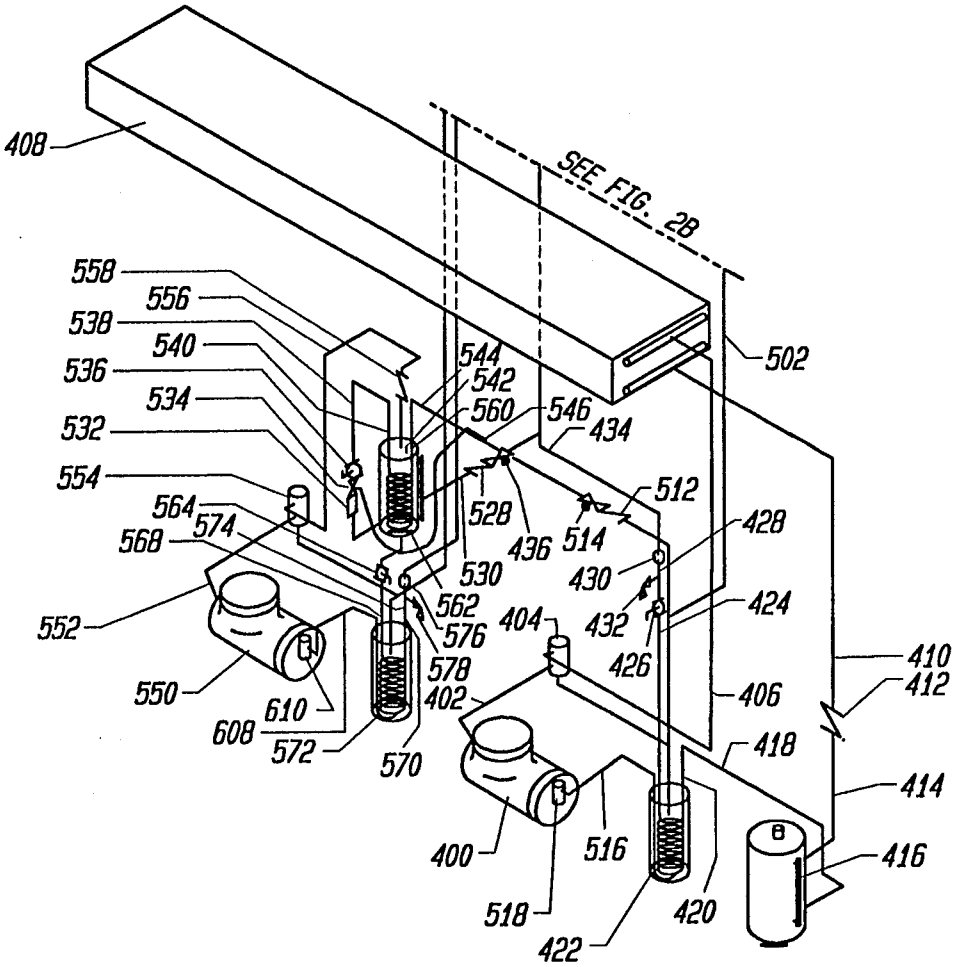
FIG. 2 shows a perspective view of a schematic diagram of the preferred embodiment of the present invention.
Figure 2B:
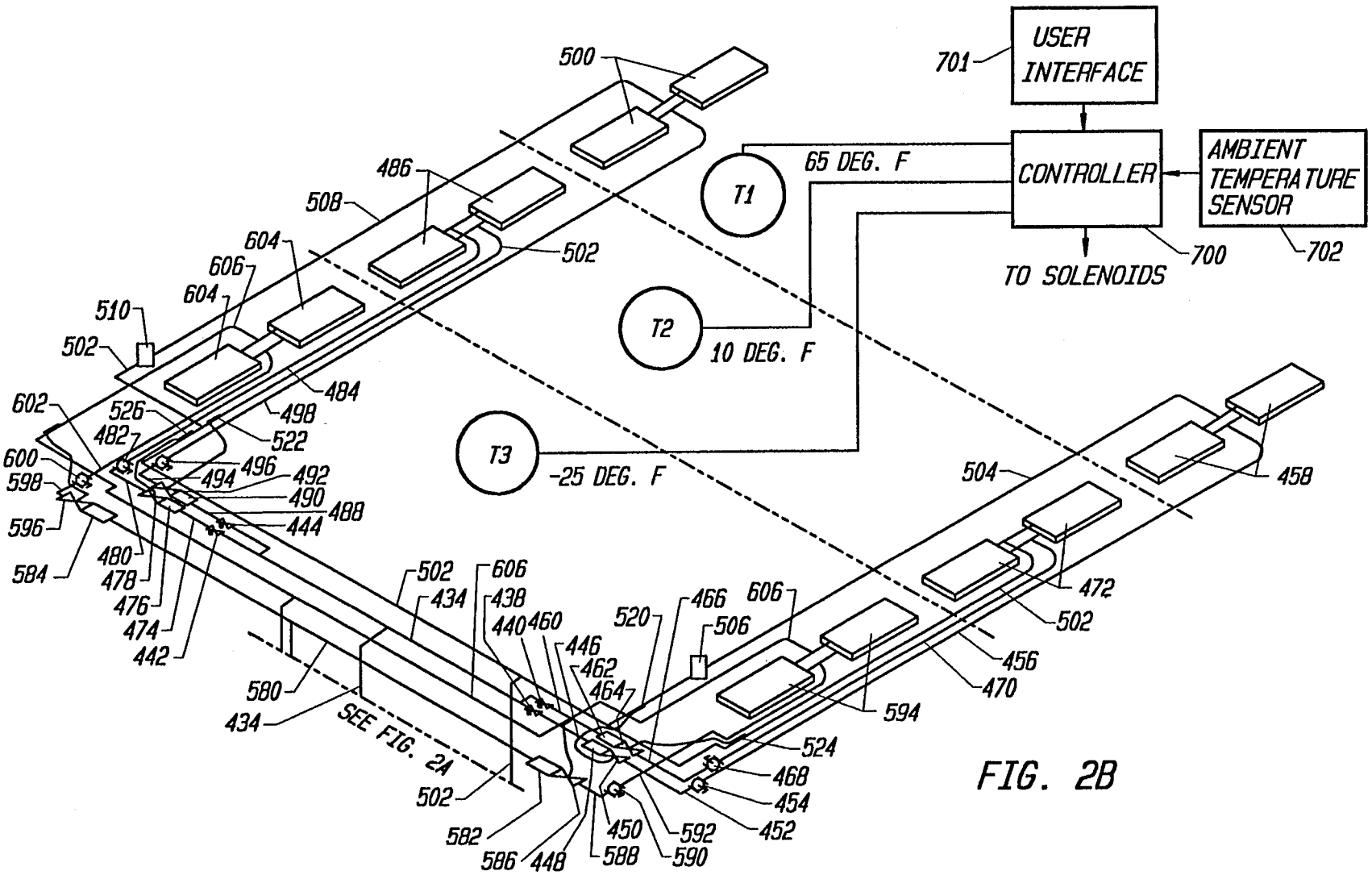

The circuit of FIG. 2 shows the multiple temperature refrigeration system of the present invention. The drawing of FIG. 2 shows a single preferred embodiment for achieving three temperatures. However, as will be described herein, the teachings of the present invention can readily be applied for achieving additional chambers with different temperatures.

A compressor 400 discharges hot gas into a hot gas pipe 402 which is coupled in turn to an oil separator 404. Unless specifically indicated in the description relative to FIG. 2, the cooling system of the present invention of FIG. 2 will operate similarly to the cooling system of the embodiment described above relative to FIG. 1. For example, the oil separator 404 will remove approximately 98% of the oil from the hot gas just like the oil separator 24 of the embodiment of FIG. 1.

The hot gas exits the oil separator 404 through the hot gas pipe 406 which is coupled to an input of a condenser 408. The hot gas gives up heat to the ambient and is condensed to a liquid in the condenser 408 which is coupled out of the condenser 408 to a liquid pipe 410. The liquid in the pipe 410 passes through the check valve 412 into the liquid pipe 414, and from there into the linear receiver 416. The liquid passes out of the receiver 416 through the liquid pipe 418 and into the coil 420 of the suction accumulator 422.

The liquid leaves the coil 420 of the suction accumulator 422 via the liquid pipe 424, where it passes through the ball valve 426, a liquid pipe 428 and a sighting glass 430. A charge valve 432 is coupled to the pipe 428 between the ball valve 426 and the sighting glass 430. The liquid then enters the liquid "Y" pipe 434, which is coupled to the liquid solenoids 436, 438, 440, 442 and 444.

First, consider an operation wherein the liquid solenoid 436 is closed and the liquid solenoids 438, 440, 442 and 444 are open. The liquid solenoid 438 is coupled to a liquid pipe 446 and in turn to a filter/dryer 448, a thermal expansion valve 450, a liquid pipe 452, a ball valve 454, a liquid pipe 456 and finally into a first evaporator system 458. Similarly, the liquid solenoid 440 is coupled to a liquid pipe 460 and in turn to a filter/dryer 462, a thermal expansion valve 464, a liquid pipe 466, a ball valve 468, a liquid pipe 470 and finally into a second evaporator system 472. Also, the liquid solenoid 442 is coupled to a liquid pipe 474 and in turn to a filter/dryer 476, a thermal expansion valve 478, a liquid pipe 480, a ball valve 482, a liquid pipe 484 and finally into a third evaporator system 486. Lastly, the liquid solenoid 444 is coupled to a liquid pipe 488 and in turn to a filter/dryer 490, a thermal expansion valve 492, a liquid pipe 494, a ball valve 496, a liquid pipe 498 and finally into a fourth evaporator system 500.

The liquid from the liquid pipe is coupled from the liquid pipe 434 through the systems described in the previous paragraph into the evaporators 458, 472, 486 and 500 where it absorbs heat, boils and becomes a cold gas. The cold gas from the evaporators 472 and 486 is coupled to a cold gas "Y" pipe 502. The cold gas from the evaporator 458 is coupled to a cold gas pipe 504 and then through an evaporator pressure regulator 506 to the cold gas "Y" pipe 502. Similarly, the cold gas from the evaporator 500 is coupled to a cold gas pipe 508 and then through an evaporator pressure regulator 510 to the cold gas "Y" pipe 502.

The cold gas "Y" pipe 502 is also coupled to a check valve 512 which in turn is coupled to a cold gas solenoid valve 514 which is closed and then to the shell of the suction accumulator 422. The output of the shell of the suction accumulator 422 is coupled to a cold gas pipe 516 which in turn is coupled to a suction dryer 518. From the suction dryer 518, the cold gas returns to the compressor 400 where the cycle is complete. In this preferred embodiment, the evaporators 458 and 500 are installed within a single first chamber of the refrigerated container. To control the proper feed of liquid refrigerant to the evaporators of the first chamber a thermostatic bulb 520 of the thermal expansion valve 450 and thermostatic bulb 522 of the thermal expansion valve 492 are each mounted to the cold gas "Y" pipe 502. A thermostat T1 which controls the temperature in the first chamber by closing the Solenoid valves 444 and 438 when the temperature reaches the set point and opening the same solenoids when the temperature rises above the set point.

The evaporators 472 and 486 are installed within a single second chamber of the container and are fed through the expansion valves 464 and 478 with the corresponding thermostatic bulbs 526 and 520 each mounted to the cold gas pipe 502. A thermostat T2 which controls the temperature in the second chamber by closing the solenoid valves 440 and 442 feeding the liquid refrigerant to the evaporators when the temperature reaches the set point and opening the same solenoids when the temperature rises. When the temperature in both chambers with positive temperatures and in the chamber with negative temperature reach the set point, in addition to closing the solenoids feeding the evaporators the compressor 400 cuts out. When the temperature in any of the three chambers rises above the set point the compressor 400 cuts in. In addition, the thermostat in the negative temperature chamber cycles the compressor 550 and cuts in compressor 400 even if the temperature conditions in the other chambers do not require the compressor 400 to run.

To obtain even more chambers with different temperatures, the first chamber can be divided into two chambers. The evaporator pressure regulator 506 can be adjusted differently than 510 to provide each of these new chambers with its own temperature controlled by its own additional thermostat. Likewise the second chamber can be divided into two chambers with different temperatures by installing an evaporator pressure regulator in line of the cold gas pipe 502 and controlling the temperature with a dedicated thermostat.

The pressure of cold gas leaving the evaporators of the first chamber is different than the pressure of the cold gas leaving the evaporators of the second chamber because the evaporator pressure regulators 510 and 506 keep the pressure higher closer to the set point in order to minimize the temperature difference between the chamber and evaporation. The higher the temperature difference the more moisture is removed from the load which causes the product to lose its attractiveness, taste and value. Otherwise, the higher temperature in the other chamber can be achieved just by cycling the solenoid valves feeding the liquid refrigerant to the evaporators controlled by a thermostat.

In those cases, where even more different temperatures are provided by one compressor, each additional temperature system is provided with an evaporator pressure regulator, a thermal expansion valve and a thermostat controlling the temperature by cycling corresponding liquid line solenoid valves.

Even with the system just described for simultaneously providing multiple temperatures the temperature range that can be generated by a single compressor system may be inadequate. Accordingly, the present invention also supports a cascade mode cooling to achieve temperatures well below 0° F. at any ambient temperatures.

In a cascade mode, the solenoid 436 is open allowing a portion of the liquid refrigerant from the liquid pipe 434 to pass through check valve 528 into a liquid pipe 530, then a filter/dryer 532, through a thermal expansion valve 534 and a ball valve 536 into a liquid pipe 538. Then, the liquid enters the evaporator side of the heat exchanger 542 where it boils at low pressure and temperature absorbing the heat of the condenser side of the heat exchanger. The cold gas leaves the evaporator side 540 of the heat exchanger 542 via the cold gas pipe 502 where it joins the cold gas from the evaporators 458, 472, 486 and 500 and passes through suction accumulator 422 and filter 518 into compressor 400 to complete its cooling cycle. The thermal expansion valve 534 controls the proper feed of the evaporator coil of the heat exchanger sensing the superheat in suction pipe 544 with the thermostatic bulb 546 mounted to the cold gas pipe 544.

A second compressor 550 compresses a cold gas supply into a supply of a hot gas which is coupled to a hot gas pipe 552 which in turn is coupled to an oil separator 554. The output of the oil separator 554 is coupled to a hot gas pipe 556 which is coupled to a check valve 558 and in turn to a hot gas pipe 560. The hot gas pipe 560 is then coupled to the condenser side of a heat exchanger 542 where it gives up the heat and condenses into liquid. The output of the condenser side of the heat exchanger 542 is coupled to a liquid pipe 562, a ball valve 564 which in turn is coupled to the coil of a suction accumulator 572.

The output of the coil 570 of the suction accumulator 572 is coupled to a liquid pipe 574 which is coupled to a charging valve 578 and a sighting glass 576. The sighting glass 576 is coupled to a liquid "Y" pipe 580 which in turn is coupled to two filter/dryers 582 and 584. The filter/dryer 582 is coupled to a thermal expansion valve 586, a liquid pipe 588, a ball valve 590, a liquid pipe 592 and an evaporator system 594. Likewise, the filter/dryer 584 is coupled in turn to a thermal expansion valve 596, a liquid pipe 598, a ball valve 600, a liquid pipe 602 and an evaporator system 604. The liquid refrigerant supplied to the evaporators 594 and 604 absorbs heat from the air of chamber and boils to a cold gas. The output of evaporator systems 594 and 604 are each coupled to the cold gas "Y" pipe 606 which is coupled in turn to the shell of the suction accumulator 572, the cold gas pipe 608, the suction filter 610 and finally back to the compressor 550 which completes the cooling cycle.

As the condenser of the compressor 550 is cooled by the evaporator of the compressor 400 in the heat exchanger 542, the cooling temperatures achieved by the compressor 550 can readily be much cooler than those achieved by the compressor 400.

The system of the preferred embodiment includes three or more chambers, each having a predetermined and preset temperature. The compressor 400 is operating a system with evaporators 458, 472, 486, 500 and the evaporator coil of the heat exchanger 542, wherein the evaporators 458 and 500 are located in the first chamber, the evaporators 472 and 486 are located in the second chamber and the evaporating coil of the heat exchanger condenses the hot gas of the low cascade compressor which operates the low temperature chamber.

The combination of the thermal expansion valves 450 and 492 with their respective thermostatic bulbs 520 and 522, the evaporator pressure regulators 506 and 510, solenoid valves 444 and 460 and thermostat T1 in the first chamber are adjusted to generate a temperature of 50° to 75° F.

The combination of the thermal expansion valves 464 and 478 with their respective thermostatic bulbs 524 and 526, solenoid valves 442 and 440 and thermostat T2 in the second chamber are adjusted to generate a temperature of 10 to 50° F.

The cascade system of compressors 400 and 550 in combination with the evaporators 594, 604 and evaporator of the heat exchanger, expansion valves 586, 596, 534 and the thermostat T3 are configured to generate a temperature −25° to 0° F. in the third chamber.

It will be apparent to one of ordinary skill in the art that more chambers with any temperature within the ranges indicated above can be arranged by dividing the container with insulated partitions and feed the corresponding evaporators with liquid refrigerant by corresponding expansion valves and control the temperature in each additional chamber with an additional corresponding thermostat which would operate the corresponding solenoid valves controlling the operation of the evaporators.

Preferably, the solenoid valves and compressors are automatically controlled by an electronic control system or it is also could be a solid state control system. In the preferred embodiment, the controller 700 is a microprocessor.

In operation, the user enters the desired temperature into each thermostat T1, T2 or T3 or controller 700 of each chamber through the user interface 701. Ambient temperature is sensed by the ambient temperature sensor 702. The controller 700 operates the solenoid valves which in turn control the operation of the corresponding evaporators and, if necessary, the compressors.

The present invention has been described relative to a preferred embodiment. Changes and modifications to this preferred embodiment that follow the teaching herein in light of the appended claims are deemed within the spirit and scope of the present invention.

What is claimed is:

1. A multiple temperature cooling system for simultaneously cooling a plurality of product loads each to one of a different predetermined temperature comprising:

a. a first refrigeration system having:

1) a first compressor;

2) a condenser coupled to the first compressor;

3) a first plurality of evaporator systems, each coupled to the first compressor and each one of the first plurality of evaporator systems having a thermal; expansion valve and a first thermostat for controlling temperature; and 4) an evaporator side of a heat exchanger coupled to the first compressor also having a thermal expansion valve which has a thermostatic bulb; and b. a second refrigeration system having:

1) a second compressor;

2) a condenser side of the heat exchanger coupled to the second compressor; and 3) a second plurality of evaporator systems, each coupled to the second compressor and each one of the first plurality of evaporator systems having a thermal expansion valve and a second thermostat for controlling temperature; and c. means for selectively conditioning each of the thermal expansion valves and its corresponding thermostat for generating a desired temperature in each corresponding one of the first and the second plurality of evaporators.

2. The multiple cooling system according to claim 1 further comprising an evaporator pressure regulator coupled in the cold gas pipe after the evaporator systems.

3. The cooling system according to claim 1 wherein both compressors use the same refrigerant.

4. The cooling system according to claim 1 further comprising an automatic controller for automatically configuring the system.

5. The cooling system according to claim 4 further comprising:

a. means for entering a desired temperature value for each of the plurality of evaporator systems to the controller; and b. a temperature sensor coupled to provide temperature data to the controller for sensing an ambient temperature.

6. The cooling system according to claim 4 further comprising a plurality of solenoids coupled for control by the controller for automatically configuring the system.

7. The multiple cooling system according to claim 4 wherein the means for selectively conditioning comprises a plurality of temperature sensors coupled to provide temperature data to the controller for sensing a temperature each of the first and the second plurality of evaporators.

8. A multiple temperature cooling system for simultaneously cooling a plurality of product loads each to one of a different predetermined temperature comprising:

a. a compressor system having a first compressor for converting a gas supply to a hot gas and coupled to provide the gas to a condenser for giving up heat to form a liquid which in turn is coupled to a plurality of evaporator systems, wherein each evaporator system includes a thermal expansion valve coupled to provide the cold liquid to an evaporator coil wherein the liquid absorbs heat and boils to form a cold gas which is returned to the compressor in a cold gas pipe, and further wherein a thermostatic bulb for the thermal expansion valve is mounted to the cold gas pipe so that each combination of a thermal expansion valve and a thermostatic bulb is adjustable for providing proper feed of the liquid to the evaporator systems to control a temperature in a corresponding evaporator system; and b. a second compressor wherein the multiple cooling system may be configured to operate in single compressor or in cascade mode.

9. The multiple cooling system according to claim 10 further comprising;

a. an automatic controller for automatically configuring the system; and b. a plurality of solenoids coupled for control by the controller for automatically configuring the system.

10. The multiple cooling system according to claim 9 further comprising;

a. means for entering a desired temperature for each of the plurality of evaporator systems to the controller;

b. a first temperature sensor coupled to provide temperature data to the controller for sensing an ambient temperature; and c. a plurality of temperature sensors coupled to provide temperature data to the controller for sensing a temperature each of the first and the second plurality of evaporators.

* * * * *

UNITED STATES PATENT AND TRADEMARK OFFICE

CERTIFICATE OF CORRECTION

PATENT NO. : 5,447,038

DATED : September 5, 1995

INVENTOR(S) : Vaynberg

It is certified that error appears in the above-identified patent and that said Letters Patent is hereby corrected as shown below:

In column 14, line 25, "10" should have been typed --8--.

Signed and Sealed this

Fourteenth Day of November, 1995

Bruce Lehman

*Attest:*

BRUCE LEHMAN

*Attesting Officer*

*Commissioner of Patents and Trademarks*